United States Patent [19]

Webber

[11] Patent Number: 4,911,363

[45] Date of Patent: Mar. 27, 1990

[54] COMBUSTION HEAD FOR FEEDING HOT COMBUSTION GASES AND SPRAY MATERIAL TO THE INLET OF THE NOZZLE OF A FLAME SPRAY APPARATUS

[75] Inventor: Roderick P. Webber, Elkhart, Ind.

[73] Assignee: Stoody Deloro Stellite, Inc., St. Louis, Mo.

[21] Appl. No.: 298,379

[22] Filed: Jan. 18, 1989

[51] Int. Cl.[4] ..... B05B 7/20

[52] U.S. Cl. ..... 239/79; 239/83; 239/132.3

[58] Field of Search ..... 239/79, 81, 82, 83, 239/84, 80, 85, 132.3, 419.3, 422, 424.5, 427, 428; 219/76.11, 76.13, 76.16, 121.47, 121.49

[56] References Cited

U.S. PATENT DOCUMENTS

| | | | |
|---|---|---|---|
| 4,343,605 | 8/1982 | Browning | 239/79 |
| 4,370,538 | 1/1983 | Browning | 239/83 |
| 4,416,421 | 11/1983 | Browning | 239/683 |
| 4,568,019 | 2/1986 | Browning | 239/83 |
| 4,593,856 | 6/1986 | Browning | 239/83 |
| 4,634,611 | 1/1987 | Browning | 239/81 |

FOREIGN PATENT DOCUMENTS

| | | | |
|---|---|---|---|
| 0136978 | 4/1985 | European Pat. Off. | 239/85 |

*Primary Examiner*—Andres Kashnikow
*Assistant Examiner*—Christopher G. Trainor
*Attorney, Agent, or Firm*—Jack Schuman

[57] ABSTRACT

An improved combustion head for use with flame spray apparatus constructed according to the principles described in U.S. Pat. No. 4,416,421 is provided with a recess in the floor of the counterbore receiving hot pressurized combustion gases from the combustion chamber. The recess is of depth sufficient to redistribute the heat of the combustion gases to prevent local hot spots in the counterbore and to avoid cracking and erosion in the combustion head by reducing thermal fatigue which occurs in cyclic use of the flame spray apparatus. The improved combustion head is also provided with radially spaced longitudinal channels extending inwardly from the periphery thereof, along which channels cooling water is passed to cool the improved combustion head.

3 Claims, 4 Drawing Sheets

COMBUSTION HEAD FOR FEEDING HOT COMBUSTION GASES AND SPRAY MATERIAL TO THE INLET OF THE NOZZLE OF A FLAME SPRAY APPARATUS

BACKGROUND OF THE INVENTION (1) Field of the Invention

This invention relates broadly to apparatus for spraying onto a substrate or workpiece molten or heat-softened material at high velocities by means of hot combustion gases.

More particularly, this invention relates to an improved combustion head for feeding hot combustion gases under pressure and solid material, which may be metal wire or metal powder, to the inlet of the nozzle of a flame spray apparatus, which material, exiting the nozzle in the molten or heat softened state, is projected at high velocity onto the surface of a substrate or workpiece, thereby to provide such substrate or workpiece with a dense and tightly adherent coating of said material.

(2) Description of the Prior Art

Flame spraying apparatus operated by hot combustion gases for coating substrates or workpieces with metal is well-known in the art, as shown, for example, in U.S. Pat. Nos. 4,342,551 (1982), 4,343,605 (1982), 4,416,421 (1983), 4,568,019 (1986) and 4,634,611 (1987).

U.S. Pat. No. 4,416,421 (1983) is particularly pertinent to the present invention and discloses high velocity flame spray apparatus comprising a combustion chamber receiving at one end thereof a continuous supply of pressurized fuel, which may be liquid or gas, through a first conduit, and a continuous supply of pressurized oxygen through a second conduit. Means, such as a spark plug, is provided to ignite the fuel. A continuous flow of highly pressurized hot combustion gases resulting from ignition of the fuel is discharged from the opposite end of the combustion chamber through a plurality of ports leading to the inlet of a relatively long nozzle having a converging throat. The longitudinal axis of the nozzle is perpendicular to the longitudinal axis of the combustion chamber, so that material, in powder form or in the form of wire, may be fed into the throat of the nozzle along the longitudinal axis of the nozzle. The ports conveying the highly pressurized combustion gases from the combustion chamber to the inlet of the nozzle are radially spaced around and are inclined toward the longitudinal axis of the nozzle so that the hot combustion gases, while propelling the material through the nozzle and in the course of doing so melting or at least heat-softening the material, restricts the flow of material through the nozzle to a thin column which does not touch the nozzle bore wall. The molten or heat-softened material exits the nozzle at high velocity and is projected onto the surface of a substrate or workpiece thereby to provide the said substrate or workpiece with a dense tightly-adhering coating of said material. Passageways for cooling water are provided around the exterior of the nozzle.

Flame spraying apparatus such as the apparatus disclosed in U.S. Pat. No. 4,416,421, operated in the manner known to the art, provides the substrate or workpiece with a coating of material having desired properties, such as abrasion resistance or corrosion resistance, lacking in the substrate or workpiece. The material constituting the coating may, for example, be far more expensive than the substrate or workpiece, and therefore considerable economies are realized by this process, in comparison with the cost of making the entire body of the substrate or workpiece of expensive material with the desired properties.

In a commercial embodiment of the flame spray apparatus disclosed in U.S. Pat. No. 4,416,421, which commercial embodiment has been used industrially in the United States and elsewhere for several years, and which is described in some detail further on in this specification, a combustion head is provided as a transition piece between the discharge end of the combustion chamber and the inlet end of the nozzle. The combustion head has a counterbore which receives the hot combustion gases continuously generated in the combustion chamber, and also is provided with a complex series of passages through which cooling water is passed. It has been observed that, in the combustion head currently in commercial use, the floor of the counterbore receiving the hot combustion gases from the combustion chamber cracks and erodes after a short period of use, thus severely limiting the useful life of this combustor head. Such cracking and erosion occurs, apparently, because of the development of local hot spots in the counterbore and thermal fatigue in the body of the combustion head adjacent to the counterbore. It is believed that cracks form, not because of the metallurgy of the combustor head, but because of the design of this counterbore.

SUMMARY OF THE INVENTION

One of the objects of this invention is to provide an improved combustion head for flame spray apparatus in which material to be sprayed is heated and propelled against a substrate or workpiece by hot combustion gases under pressure.

A further object of this invention is to provide an improved combustion head for flame spray apparatus which will have a significantly extended life over that of the currently known combustion head.

Yet another object of this invention is to provide an improved combustion head which will withstand heat cracking and erosion which occurs with conventional combustion heads in cyclic use under the influence of hot combustion gases under pressure.

Still a further object of this invention is to provide an improved combustion head of more efficient design for removing heat therefrom by a cooling medium.

Other and further objects of this invention will become apparent during the course of the following description and by reference to the accompanying drawings and appended claims.

Briefly, the foregoing objects are attained by providing a recess in the floor of the counterbore of the combustion head of the present commercial embodiment of flame spray apparatus shown in U.S. Pat. No. 4,416,421, which counterbore receives the continuous flow of hot pressurized combustion gases from the combustion chamber of the flame spray apparatus. The depth of the recess is sufficient to redistribute the heat of the combustion gases to prevent local hot spots in the counterbore and to avoid cracking and erosion in the combustion head by reducing thermal fatigue which occurs in cyclic use of the apparatus. The inlets of the inclined passages leading to the inlet of the nozzle of the flame spray apparatus, which inclined passages conduct the continuous flow of hot pressurized combustion gases from the combustion chamber to the inlet of the nozzle of the flame spray apparatus, communicate with the counterbore only through the recess in the floor of the counterbore, and not through the floor of the counterbore. The foregoing objects are attained, further, by providing a plurality of radially spaced recesses or channels extending longitudinally along the periphery of the combustion head which cooperate with the inside of the housing holding the combustion head to define longitudinal passageways for cooling medium, thereby dispensing with all internal conduits in the body of the combustion head for cooling medium.

BRIEF DESCRIPTION OF THE DRAWINGS

Referring now to the drawings in which like numerals represent like parts in the several views.

DESCRIPTION OF THE PREFERRED EMBODIMENT

Figure 1:
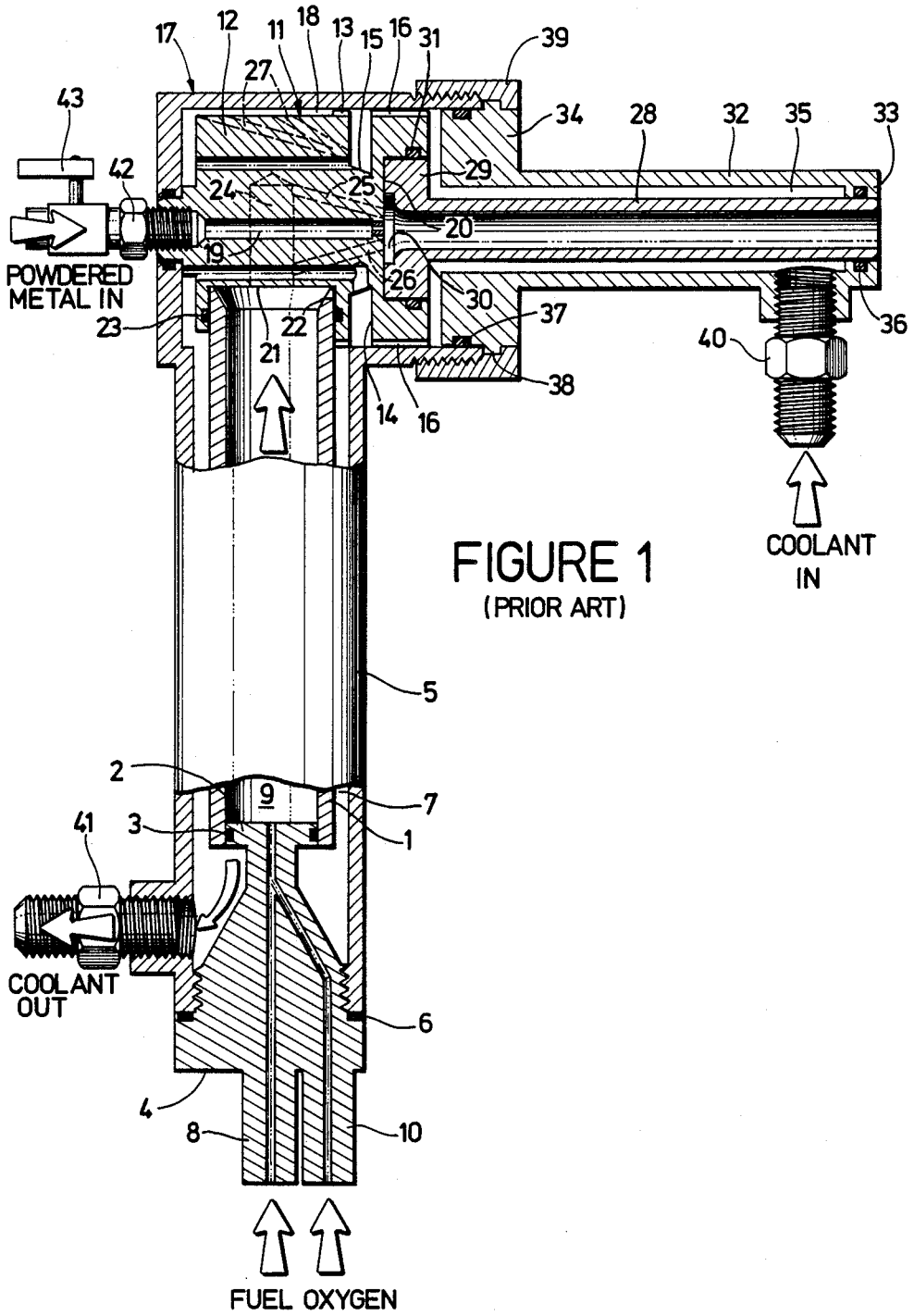
FIGURE 1 (PRIOR ART)
FIG. 1 represents a view in side elevation, partially in section, of the present commercial embodiment of flame spray apparatus disclosed in U.S. Pat. No. 4,416,421.
Figure 2:
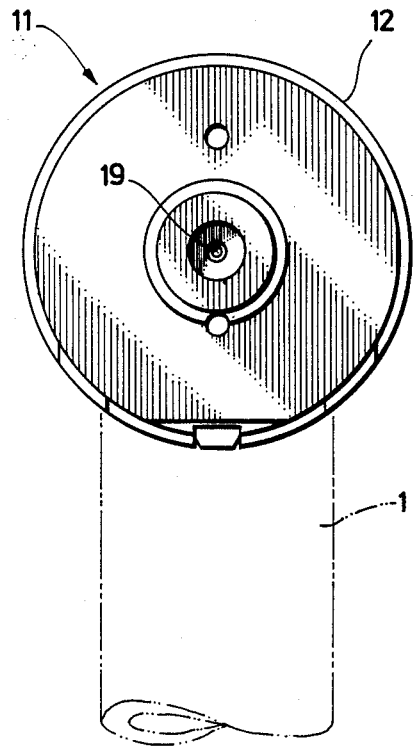
FIGURE 2 (PRIOR ART)
FIG. 2 represents a view in end elevation of the upstream or left end (as viewed in FIG. 1) of the present commercial embodiment of combustion head, showing in phantom for ease of comprehension the tube defining the combustion chamber.
Figure 3:
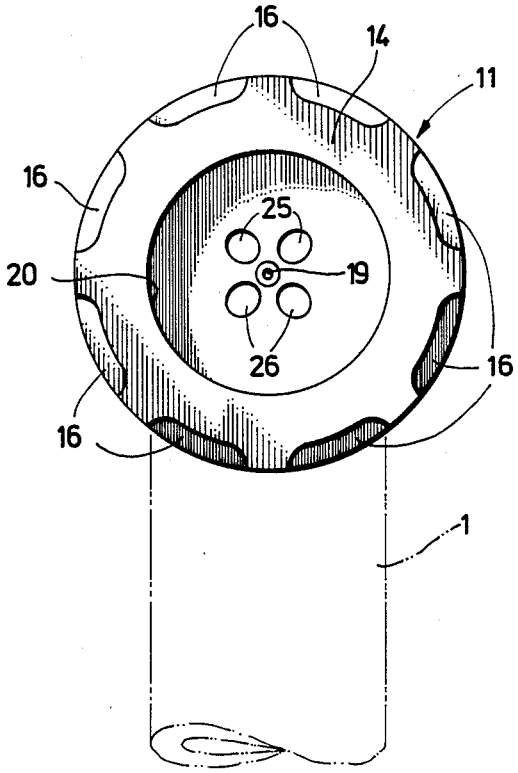
FIGURE 3 (PRIOR ART)
FIG. 3 represents a view in end elevation of the downstream or right end (as viewed in FIG. 1) of the present commercial embodiment of combustion head, showing in phantom for ease of comprehension the tube defining the combustion chamber.
Figure 4:
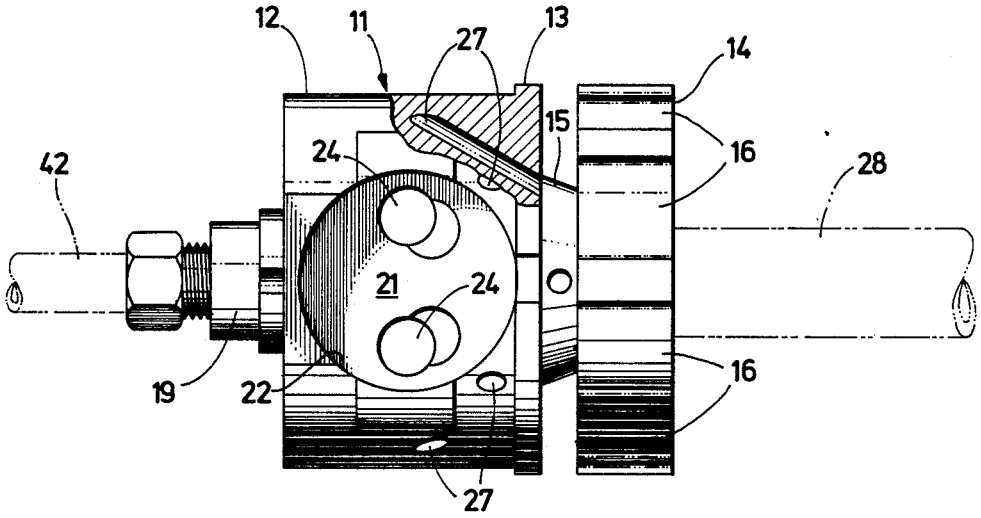
FIGURE 4 (PRIOR ART)
FIG. 4 represents a view of the bottom of the present commercial embodiment of combustion head shown in FIG. 1, showing in phantom for ease of comprehension the material feed conduit and the nozzle.

The structure and operation of the improved combustion head constituting the present invention is best understood by referring first to the present commercial embodiment of flame spray apparatus disclosed in U.S. Pat. No. 4,416,421.

As shown in FIGS. 1–4, the present commercial embodiment of flame spray apparatus comprises metallic tube 1 closed at one end thereof by means of plug 2 with O-ring 3 mounted around the periphery of plug 2 and engaging the interior of tube 1 so as to provide a seal therebetween. Plug 2 is formed integrally with end plug 4 which is threaded to one end of housing 5, gasket 6 being mounted on end plug 4 to provide a seal.

Housing 5 is formed with an inside diameter somewhat larger than the outside diameter of tube 1, thereby to provide an annular space 7 therebetween.

Fuel conduit 8 extends through end plug 4 and plug 2 to communicate with the interior 9 of tube 1. Oxygen conduit 10 extends through end plug 4 and communicates with fuel conduit 8 as shown.

Under this arrangement, a mixture of fuel (which may be liquid or gas) and oxygen is fed into the interior 9 of tube 1 which is the combustion chamber of this flame spray apparatus.

Metallic combustion head 11 is seen as comprising body portion 12 formed with flange 13 of somewhat larger diameter than body portion 12, nozzle receiving portion 14, and tapered transition portion 15. Nozzle receiving portion 14 has the same diameter as flange 13, and is provided with inwardly extending recesses 16 radially spaced about the longitudinal axis of combustion head 11. Housing 17 is connected in a leakproof manner to housing 5. Flange 13 and nozzle receiving portion 14 are slidably received in housing 17 thereby to stably position combustion head 11 within housing 17 and maintain an annular space 18 between the periphery of body portion 12 and housing 17.

Material feed passage 19 extends entirely through combustion head 11, from the upstream end thereof and along the longitudinal axis thereof and communicates with bore 20 in the downstream end of nozzle receiving portion 14.

The open end of tube 1 (i.e., that end opposite the end receiving plug 2) extends into, and bears against, the floor 21 of counterbore 22 formed in body portion 12 of combustion head 11. O-ring 23 is mounted in the wall of counterbore 22 and engages the periphery of tube 1 to provide a seal therebetween.

Two bores 24 extend from the floor 21 of counterbore 22 into the body portion 12 of combustion head 11, positioned on either side of the longitudinal axis of combustion head 11, and are arranged with their longitudinal axes parallel to each other. One bore 24 will therefore lie in front of the plane of FIG. 1, and the other bore 24 will lie behind the plane of FIG. 1.

Combustion gas passages 25 communicate between those ends of bores 24 remote from counterbore 22 and bore 20 of nozzle receiving portion 14, and combustion gas passages 26 communicate between those ends of bores 24 adjacent counterbore 22 and bore 20 of nozzle receiving portion 14. Combustion gas passages 25 and 26 converge about and are equidistant from material feed passage 19 where it meets bore 20, and are radially equispaced about the longitudinal axis of combustion head 11 where they meet bore 20.

Passageways 27 to receive cooling water are drilled through the body portion 12 of combustion head 11 in such orientation as to communicate between the downstream face of flange 13 (i.e., that face of flange 13 adjacent tapered transition portion 15) and various locations around the periphery of body portion 12 adjacent the upstream and downstream ends of the said body portion 12.

Metallic nozzle 28 is provided with flange 29, in which is formed a converging throat 30. Flange 29 is seated in bore 20 of nozzle receiving portion 14 of combustion head 11, and an O-ring 31 is mounted in the wall of bore 20 and engages the periphery of flange 29 so as to provide a seal therebetween. The entrance to (i.e., the larger end of) converging throat 30 of nozzle 28 is of diameter large enough to fully encompass the exit ends of the four combustion gas passages 25 and 26 where they meet the floor of bore 20, the said exit ends being radially equispaced about the exit end of the material feed passage 19 and about the longitudinal axes of the combustion head 11 and the nozzle 28 as aforesaid.

Housing 32 is provided with centrally apertured sleeve 33 at its downstream end and flange 34 at its upstream end. The downstream end of nozzle 28 extends into sleeve 33 and is thereby maintained in such centered relationship to housing 32 as to define an annular space 35 therebetween. O-ring 36 is mounted in the wall of the aperture of sleeve 33 and engages the periphery of nozzle 28 so as to provide a seal between the downstream end of the nozzle 28 and the sleeve 33 of housing 32.

Flange 34 of housing 32 is closely received in the downstream end of housing 17, O-ring 37 mounted around the periphery of flange 34 engages the interior of housing 17 so as to provide a seal therebetween. Flange 34 is enlarged in diameter at its downstream end so as to provide a circumferential ring 38 adapted to bear against the downstream end of housing 17 when internally threaded collar 39 is slipped over housing 32 and threaded onto threads provided around the periphery of the downstream end of housing 17.

Housing 17 is provided at its downstream end with inlet connection 40 through which cooling water is introduced into annular space 35.

Housing 5 is provided at that end adjacent end plug 4 with outlet connection 41 from which cooling water is discharged.

Material feed conduit 42 extends through the upstream end of housing 17 and communicates with the inlet or upstream end of material feed passage 19 in combustion head 11. Valve 43 is provided in material feed conduit 42 to regulate the flow of powder feed therethrough.

The operation of the commercial embodiment of flame spray apparatus disclosed in U.S. Pat. No. 4,416,421 is as follows:

Cooling water is introduced through inlet connection 40 into annular space 35 around nozzle 28. The cooling water then passes through recesses 16 in nozzle receiving portion 14 of combustion head 11 and around tapered transition portion 15 and into passageways 27 beginning at the downstream face of flange 13, thence through the body portion 12 and exiting at various points around the periphery of said body portion 12.

Thereafter, the cooling water passes into annular space 18 in housing 17, and thence into annular space 7 in housing 5 around tube 1, and out through outlet connection 41.

Fuel and oxygen are introduced through conduits 8 and 10, respectively, into the interior 9 of tube 1. The fuel-oxygen mixture is ignited as it exits nozzle 28, and the flow of fuel-oxygen mixture is regulated to permit the flame to strike back into the tube 1, and thereafter the fuel-oxygen mixture is continuously burned in tube 1, generating a continuous flow of hot combustion gases under pressure, travelling into bores 24, and thence through combustion gas passages 25 and 26 into the throat 3 of nozzle 28 and through the nozzle 28 and out the exit end thereof.

It is sometimes desired to feed hydrogen through fuel conduit 8 to mix with oxygen fed through oxygen conduit 10 to facilitate the initial ignition at the exit end of the nozzle 28.

Material to be sprayed on substrate or workpiece is fed through material feed conduit 42 into material feed passage 19 and thence into throat 30 of nozzle 28.

As disclosed in U.S. Pat. No. 4,416,421, the converging flow of hot combustion gases entering throat 30 of nozzle 28 constricts the diameter of the column of powdered material in the nozzle 28, so that such material, while travelling through the nozzle 28 and being melted or at least heat softened in passing through the nozzle 28, does not touch the bore of nozzle 28, thereby to avoid fouling of the nozzle 28.

It has been noted that, in the present commercial design of combustion head 11, severe cracking and erosion occurs in the floor 21 of counterbore 22 adjacent bores 24 as a result of thermal fatigue caused by cyclic operation during the course of which hot combustion gases from the combustion chamber in tube 1 flow under pressure into the said bores 4. Such cracking and erosion has been observed to extend into passageways 27, resulting in cooling water mixing with hot combustion gases and adversely affecting the quality of coating applied to the substrate or workpiece. This phenomenon severely reduces the useful life of the combustion head 11. It has been observed that cracking to such an extent as to render combustion head 11 totally useless occurs on the average after approximately 25–40 hours of use.

It has also been observed that the design of combustion head 11, insofar as it relates to the provision therein of a complex arrangement of passageways 27 for cooling water, is in need of improvement.

The prior art combustion head 11 having been described as aforesaid, this specification will now turn to improved combustion head 44 which is seen as comprising body portion 45, nozzle receiving portion 46 and tapered transition portion 47.

Body portion 45 is provided with counterbore 48 having a floor 49. Recess 50 is provided in the floor 49 of counterbore 48, and is of depth sufficient to redistribute the eat of the combustion gases entering body portion 45, so as to prevent local hot spots in counterbore 48 and to avoid cracking and erosion in body portion 45 by reducing thermal fatigue caused by cyclic operation of the flame spray apparatus under high temperature. In the preferred embodiment, recess 50 has a depth (below the floor 49 of counterbore 48) of 0.25 inches. O-ring 51 is mounted in the wall of counterbore 48, and engages the periphery of tube 1 to provide a seal therebetween when the open end (i.e., that end opposite the end receiving plug 2) of tube 1 is inserted into counterbore 48, as with the prior art apparatus.

Radially spaced longitudinally extending channels 52 are formed in body portion 45, from the upstream end to the downstream end thereof, leaving islands 53 between adjacent channels 52. The islands 53 are provided with flange portions 54 at the downstream ends thereof, and projections 55 intermediate the upstream and downstream ends thereof.

Nozzle receiving portion 46 has an outside diameter which is smaller than the outside diameter of body portion 45, and is provided with radially spaced ears 56 defining passageways 57 therebetween, and with bore 58 in the downstream end of nozzle receiving portion 46. O-ring 59 is mounted in the wall of bore 58 and engages the periphery of flange 29 of nozzle 28 to provide a seal therebetween when flange 29 is inserted into bore 58, as with the prior art apparatus.

The extremes of flange portions 54 on islands 53, projections 55 on islands 53, and ears 56 on nozzle receiving portion 46 lie on circles of the same diameter which are slightly smaller than the inside diameter of housing 17, whereby improved combustion head 44 may be slidably received in, and stably supported in, housing 17.

Material feed passage 60 extends entirely through improved combustion head 44, from the upstream end to the downstream end thereof and along the longitudinal axis thereof, and communicates with bore 58 in the downstream end of nozzle receiving portion 46.

Figure 5:
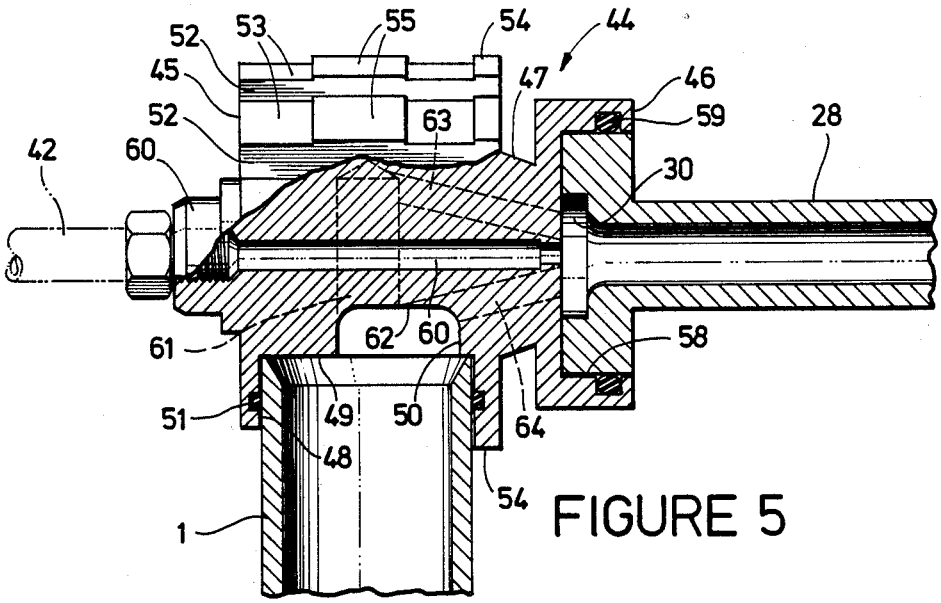
FIG. 5 represents a view in side elevation of the improved combustion head, partially in section, showing for ease of comprehension the tube defining the combustion chamber, the nozzle and, in phantom, the material feed conduit.
Figure 6:
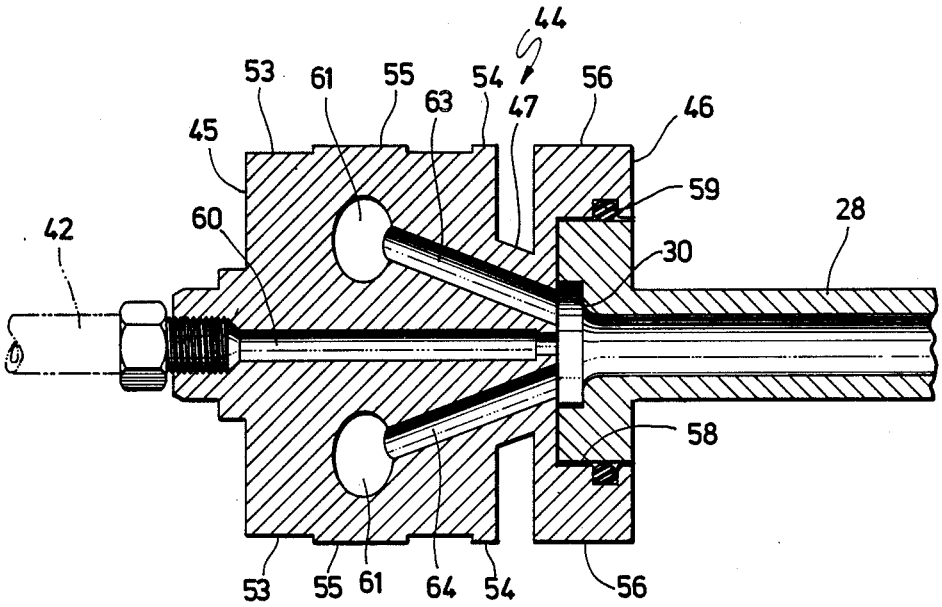
FIG. 6 represents a section of the improved combustion head taken along the line 6—6 of FIG. 7, showing for ease of comprehension the nozzle and, in phantom, the material feed conduit.
Figure 7:
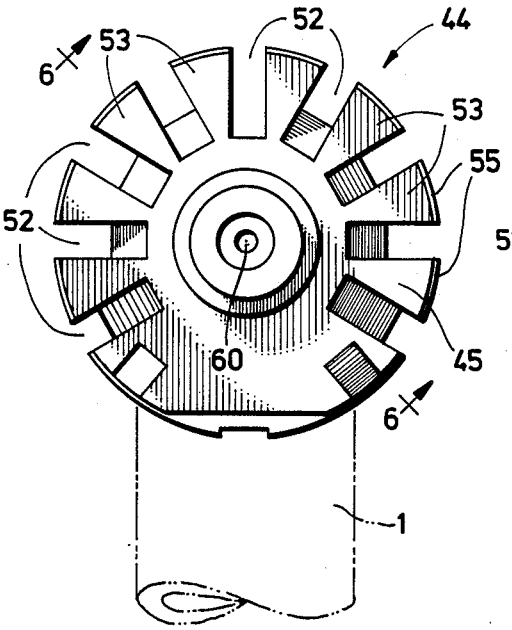
FIG. 7 represents a view in end elevation of the upstream end of the combustion head, showing in phantom for ease of comprehension the tube defining the combustion chamber.
Figure 8:
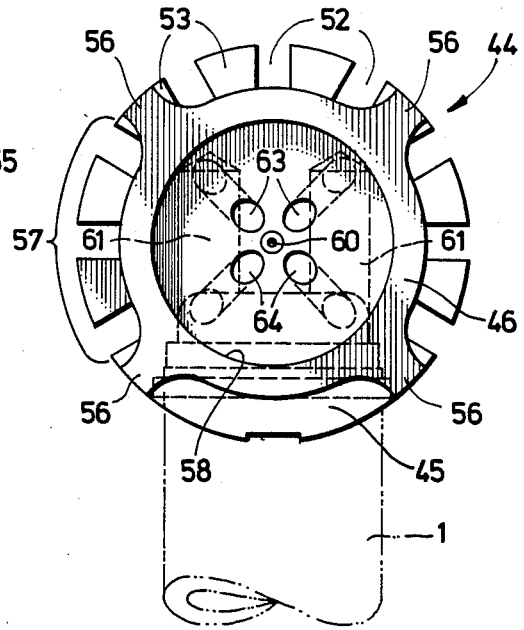
FIG. 8 represents a view in elevation of the downstream end of the improved combustion head, showing in phantom for ease of comprehension the tube defining the combustion chamber.
Figure 9:
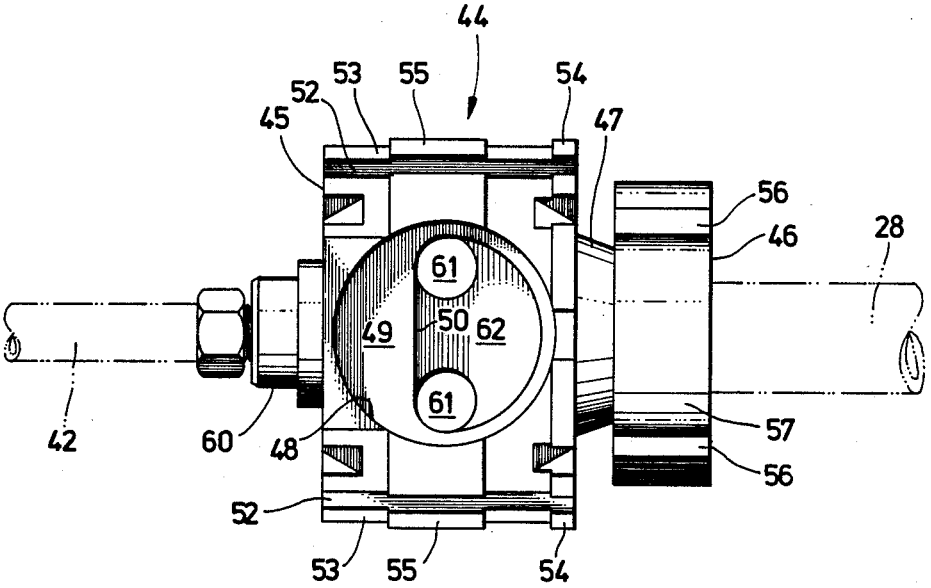
FIG. 9 represents a view of the bottom of the improved combustion head, showing in phantom for ease of comprehension, the material feed conduit and the nozzle.

Two bores 61 extend from the floor 62 of recess 50 into the body portion 45 of improved combustion head 44, positioned on either side of the longitudinal axis of combustion head 44 and are arranged with their longitudinal axes parallel to each other. One bore 61 will therefore lie in front of the plane of FIG. 5, and the other bore 61 will lie behind the plane of FIG. 5.

Combustion gas passages 63 communicate between those ends of bores 61 remote from recess 50 and bore 58 of nozzle receiving portion 46, and combustion gas passages 64 communicate between those ends of bores 61 adjacent recess 50 and bore 58 of nozzle receiving portion 46.

Combustion gas passages 63 and 64 converge about material feed passage 60 where it meets bore 58, are equidistant from material feed passage 60, and are radially spaced about the longitudinal axis of combustion head 44. The entrance to (i.e., the larger end of) converging throat 30 of nozzle 28 is of diameter large enough to fully encompass the exit ends of the four combustion gas passages 63 and 64 where they meet the floor of bore 58, and lies on the longitudinal axis of said bore 58 (which is on the longitudinal axis of combustion head 44), as with the prior art combustion head 11.

Flame spray apparatus embodying the improved combustion head 44 is assembled in the same manner as the prior art torch constructed according to the principles disclosed in U.S. Pat. No. 4,416,421, improved combustion head 44 simply being substituted for prior art combustion head 11, the same connections for cooling water intake and discharge, fuel and oxygen supply and powder feed being made, and the same connections with tube 1 and nozzle 28 being made.

Specifically, improved combustion head 44 is positioned in housing 5. Tube 1 is fully inserted into counterbore 48 of combustion head 44, engaging the floor 49 of said counterbore 48, O-ring 51 providing a seal between the wall of counterbore 48 and the periphery of tube 1. Flange 29 of nozzle 28 is fully inserted into bore 58 in the downstream end of nozzle receiving portion 46, engaging the floor of said bore 58, O-ring 59 providing a seal between the wall of bore 48 and the periphery of flange 29. As with the prior art apparatus, housing 17 is provided at its downstream end with inlet connection 40 through which cooling water is introduced into annular space 35 between nozzle 28 and housing 17. Similarly, housing 5 is provided at that end adjacent plug 4 with outlet connection 41 from which cooling water is discharged. Further, material feed conduit 42 extends through the upstream end of housing 17 and communicates with the inlet or upstream end of material feed passage 60 in improved combustion head 44, valve 43 being provided in material feed conduit 42 to regulate the flow of powder feed therethrough, and fuel conduit 8 and oxygen conduit 10 are connected through end plug 4 and plug 2 so as to communicate with the interior of tube 1, all as with the prior art apparatus.

Flame spray apparatus embodying the improved combustion head 44 is operated in the same manner as the present commercial embodiment of apparatus constructed according to the principles disclosed in U.S. Pat. No. 4,416,421.

However, with the improved combustion head 44 positioned within housing 32, cooling water which has flowed from water inlet connection 40 through annular space 35 between nozzle 28 and housing 32 passes through passageways 57 between ears 56 on nozzle receiving portion 46 and thence along channels 52 between islands 53 in body portion 45, thus effectively cooling improved combustion head 44. Cooling water passes out of said channels 52, past the projections 55 on islands 53 and into annular space 6 between tube 1 and housing 5, and thence through water outlet connection 41 to discharge.

The provision of recess 50 in floor 49 of counterbore 48, of depth sufficient to redistribute the heat of combustion gases entering body portion 45 thereby to prevent local hot spots in counterbore 48 so as to avoid cracking and erosion in body portion 45 by reducing thermal fatigue caused by cyclic operation of the flame spray apparatus under high temperature, has resulted in combustion head 44 exhibiting a useful life in excess of 150 hours, aproximately 4–6 times longer than that attained by the present commercial embodiment of combustion head exemplified by combustion head 11 hereinbefore described.

It will be apparent to those skilled in the art to which this invention pertains, after understanding the invention, that various changes and modifications may be made therein without departing from the spirit and scope of the invention as defined by the appended claims.

I claim:

1. A combustion head for use with a flame spray apparatus having a tubular combustion chamber with an open end from which hot pressurized combustion gases are discharged, a throated nozzle from which heat softened or molten particles of material to be sprayed are projected, and means for circulating cooling medium therethrough, said combustion head having a longitudinal axis and comprising:

(a) a first counterbore extending laterally of said longitudinal axis and partially into said combustion head and terminating in a floor, said first counterbore being adapted to receive in fluid-tight relationship the open end of said tubular combustion chamber, (b) a recess in the floor of said first counterbore extending into said combustion head, the depth of said recess below the floor of said first counterbore being sufficient to prevent local hot spots in said first counterbore thus to avoid cracking and erosion in the combustion head and to reduce thermal fatigue, (c) a material feed conduit having an upstream end and a downstream end and extending along the longitudinal axis of said combustion head from the upstream end of said combustion head to the downstream end of said combustion head, the upstream end of said material feed conduit being adapted for connection to a source of material which is to be sprayed, (d) a second counterbore at the downstream end of said combustion head extending partially upstream into said combustion head along the longitudinal axis thereof, said second counterbore being adapted to receive in fluid-tight relationship the upstream end of said nozzle with the longitudinal axis of said nozzle in alignment with the longitudinal axis of said second counterbore, said combustion head and said material feed conduit, (e) bore means extending from said recess in the floor of said first counterbore into said combustion head, (f) a plurality of combustion gas conduits communicating between said bore means and the downstream end of said combustion head, the downstream ends of said combustion gas conduits converging about the downstream end of said material feed conduit obliquely to the longitudinal axis of said material feed conduit, (g) the downstream ends of said plurality of combustion gas conduits being radially spaced about the longitudinal axis of said material feed conduit, equidistant from said material feed conduit, and closely grouped about the downstream end of said material feed conduit so as to lie within a circle having a diameter smaller than the diameter of the entrance to the throat of the nozzle.

2. A combustion head as in claim 1, wherein:

(h) the depth of said recess below the floor of said first counterbore is approximately 0.25 inches.

3. A combustion head as in claim 1, further comprising:

(h) a plurality of channels extending longitudinally of and laterally into said combustion head from the periphery thereof, said channels being adapted to receive a flow of cooling medium therealong.

* * * * *

UNITED STATES PATENT AND TRADEMARK OFFICE

CERTIFICATE OF CORRECTION

PATENT NO. : 4,911,363

DATED : March 27, 1990

INVENTOR(S) : Roderick Paul Webber

It is certified that error appears in the above-identified patent and that said Letters Patent is hereby corrected as shown below:

In the specification, column 6, line 43, before "of the combustion gases" delete "eat" and substitute therefor --heat--.

Signed and Sealed this

Nineteenth Day of June, 1990

*Attest:*

*Attesting Officer*

HARRY F. MANBECK, JR.

*Commissioner of Patents and Trademarks*